US006964615B2

(12) United States Patent
Lee

(10) Patent No.: US 6,964,615 B2
(45) Date of Patent: Nov. 15, 2005

(54) ADJUSTABLE SLOPE AND CONTOUR PRACTICE PUTTING GREEN ASSEMBLY AND METHOD

(76) Inventor: Duckchan Lee, 6400 Christie Ave., #5412, Emeryville, CA (US) 94608

( * ) Notice: Subject to any disclaimer, the term of this patent is extended or adjusted under 35 U.S.C. 154(b) by 0 days.

(21) Appl. No.: 10/428,376

(22) Filed: May 5, 2003

(65) Prior Publication Data

US 2004/0224783 A1 Nov. 11, 2004

(51) Int. Cl.[7] ..... A63B 69/36
(52) U.S. Cl. ..... 473/160
(58) Field of Search ..... 473/160, 161, 473/279

(56) References Cited

U.S. PATENT DOCUMENTS 3,508,756 A * 4/1970 Bedford, Jr. ..... 473/160
3,633,917 A * 1/1972 Anderson ..... 473/279
3,869,127 A * 3/1975 Kohori ..... 473/279
4,114,887 A * 9/1978 DelRaso ..... 473/153
4,240,637 A * 12/1980 Cross et al. ..... 473/160
4,611,809 A * 9/1986 Gettelfinger ..... 473/161
4,790,538 A * 12/1988 Gettelfinger ..... 473/161
4,928,966 A * 5/1990 Miller ..... 473/262
5,549,522 A * 8/1996 Chang ..... 473/279
5,863,256 A * 1/1999 MacLean et al. ..... 473/160
6,338,682 B1 * 1/2002 Torchia et al. ..... 473/160
6,514,152 B1 * 2/2003 Huang et al. ..... 473/279

* cited by examiner

*Primary Examiner*—Mark S. Graham
(74) *Attorney, Agent, or Firm*—Dorsey & Whitney LLP

(57) ABSTRACT

An adjustable contour and slope practice putting green assembly having a base (22) and a practice putting green platform (21) mounted to the base for support of the platform (21) and a player standing on a support area (28) of the platform (21) over the base (22). The base (22) is formed for selective tilting of the platform (21). The weight of a player standing on the putting green platform (21) is used to hold or fix the platform (21) to the base (22) in an adjusted position. The platform (21) is cantilevered away from the base (22) and preferably the base assembly (22) includes a spherical surface structure (34,51) and a ring (23) cooperatively formed to enable universal adjustment of the slope of the platform (21) about the center of a spherical surface (34,51) when the player is not standing on the platform. The platform may be deformable, for example, by including a deformable peripheral frame (42) which enables adjustment of the contour of the playing surface (29) in addition to adjustments to the slope of the surface (29). The contour adjustment is independent of the slope adjustment. A method of using an adjustable slope, contour and length practice putting green assembly also is provided.

21 Claims, 7 Drawing Sheets

ADJUSTABLE SLOPE AND CONTOUR PRACTICE PUTTING GREEN ASSEMBLY AND METHOD

TECHNICAL FIELD

The present invention relates, in general, to golf practice equipment, and more particularly, relates to practice putting greens which have adjustable surface slopes and contours and methods for use of the same.

BACKGROUND ART

There are numerous golf practice putting systems or devices which allow a golfer to practice his or her putting at home or away the golf course. Many of these devices include a "cup" with a short ramp to the cup that can be placed on a carpet or rug to allow the golfer to practice putting on the carpet. While these practice devices have some value, they do not allow the golfer to practice while putting on sloped or contoured surfaces, thus practice putts with such prior art devices are essentially flat.

Various golf practice systems have been devised, however, in which tilting or adjustment of the slope of the surface on which the golfer is practicing is possible. Thus, U.S. Pat. Nos. 5,518,245; 5,333,876; 5,046,741; and 2,937,875 all disclose tiltable practice surfaces on which a golfer can practice hitting up-hill or down-hill lies with various non-putter clubs. These systems tend to be based upon the use of a tiltable platform or table, but they are not intended for putting practice.

U.S. Pat. Nos. 6,146,284; 5,431,403; 4,709,538; 3,366,388; and 2,334,540 disclose devices which are designed to enable putting practice and they disclose structures which enable adjustment of the slope or contour of the putting green. These systems range in sophistication and complexity from a relatively simple tiltable surface of U.S. Pat. No. 5,431,403 to complex contour adjustable systems as is shown in U.S. Pat. No. 4,790,538. Most of these systems, however, have tended to be unduly complex and costly, and therefore, they often are not well suited for home use.

An example of a commercially available practice putting green is the system sold under the trademark PUTTGOLF. The PUTTGOLF system is capable of adjustment of both the slope and contour of the putting surface. It employs a plurality of support rods and adjustable feet and can be assembled at home and adjusted periodically by the user. While capable of a wide range of adjustments, the PUTTGOLF system is time-consuming to assemble and tedious to adjust.

Accordingly, it is an object of the present invention to provide an adjustable contour and slope putting device which can be easily assembled and in which at least one of the contour and the slope of the putting surface can be rapidly adjusted.

A further object of the present invention is to provide an adjustable practice putting green assembly which is durable, capable of length adjustments as well as slope and contour adjustments, is relatively inexpensive to manufacture and can be easily transported from place to place and reassembled and used.

The adjustable practice putting green assembly and method of the present invention have other objects and features of advantage which will become apparent from, and are set forth in more detail in, the following description of the Best Mode of Carrying Out the Invention and the accompanying drawing.

SUMMARY OF THE INVENTION

The adjustable practice putting green assembly of the present invention is comprised, briefly, of a base and a practice putting green platform. The platform is formed with a hole or cup proximate one side thereof and with a player support area spaced from the hole. A simulated green or putting surface extends over the platform between the hole and player support area. In the adjustable practice putting green assembly of the present invention, the putting green platform is mounted to the base for support of the putting green structure, and player standing on the player support area, with the putting green being cantilevered laterally from the base to position the hole at a laterally spaced distance from the base. The base is formed for selective tilting of the putting green structure relative to a horizontal plane, and is formed to hold the putting green platform in a tilted condition on the base when the player stands on the player support area. Cantilever support of the platform on the base is advantageously accomplished by forming the base and putting green platform for tilting of the platform about a spherical surface. The putting green platform also may be extended or retracted relative to the base so that the cantilevered distance of the hole or cup from the player support area can be varied.

While in the broadest aspect of the present invention the platform can simply be formed of a deformable sheet of material, the putting green platform also may be provided by a flexible putting green surface and a deformable peripheral frame with the flexible putting green surface being coupled to the frame. In this embodiment, the frame is formed for selective deformation by the user to enable adjustment of the contours or undulations in the flexible putting green surface.

The method of using an adjustable practice putting green is also provided and is comprised, briefly, of the steps of selecting an adjustable putting green assembly having a practice putting green platform movably mounted over a base for tilting of the platform; adjusting the orientation of the practice putting green platform relative to the base while the platform is unweighted; and thereafter standing on the practice putting green platform in a superimposed position over the base to frictionally hold the platform in the adjusted condition under the weight of the player while putting a golf ball toward the hole; and putting a golf ball while standing on the platform. As an additional step, the platform can be deformed to form a contoured surface prior to the standing step.

BEST MODE OF CARRYING OUT THE INVENTION

Figure 1:
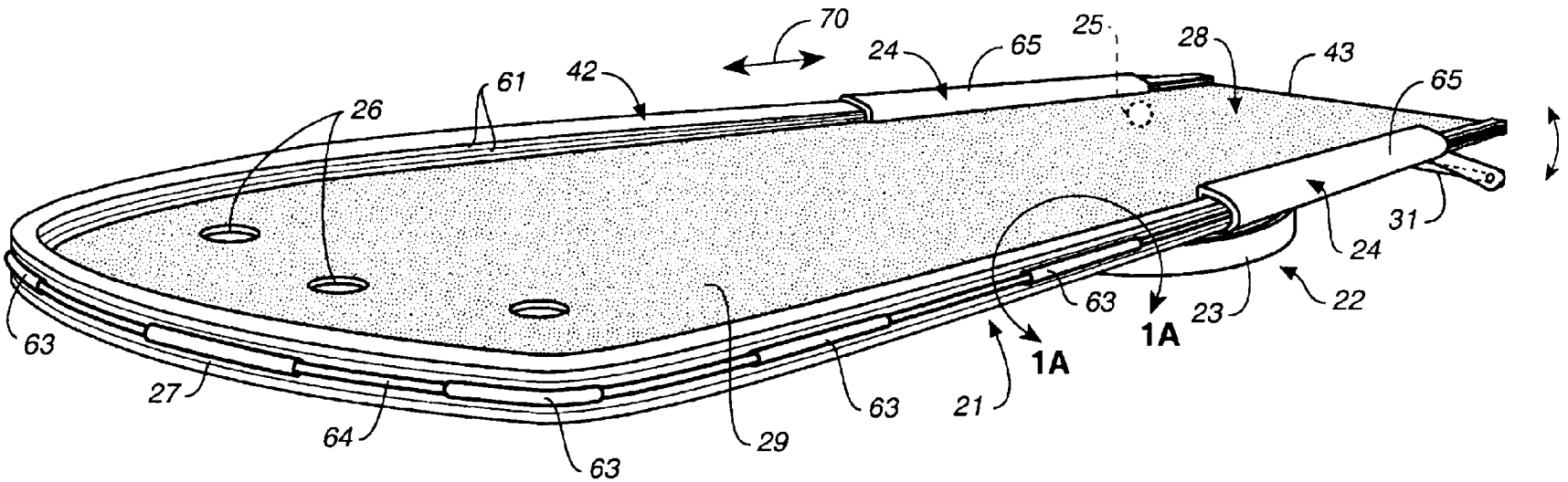
FIG. 1 is a top perspective view of an adjustable practice putting green assembly constructed in accordance with the present invention.
Figure 2:
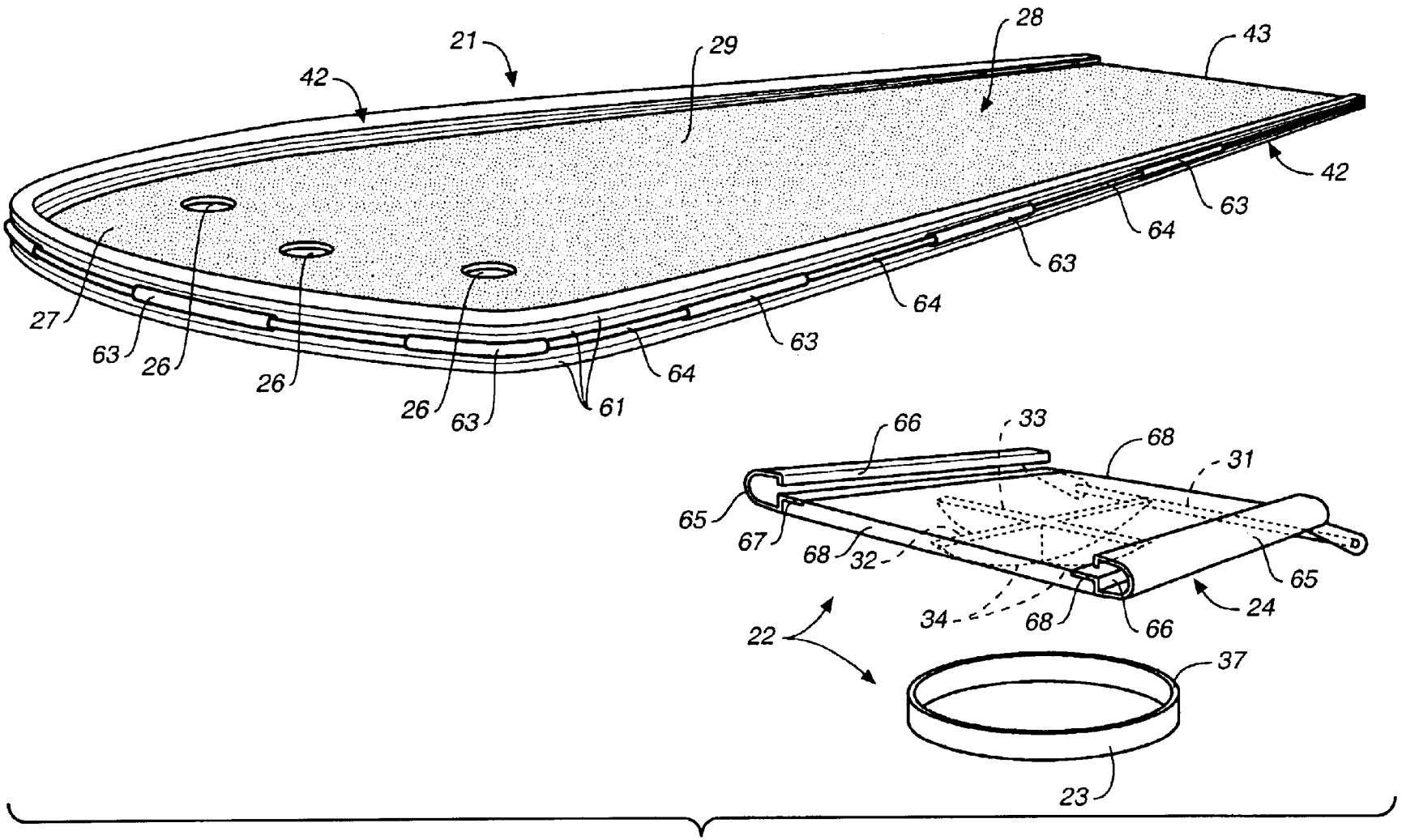
FIG. 2 is a top perspective exploded view of the assembly of FIG. 1 showing the three major components of the assembly.

The major components of the adjustable practice putting green assembly of the present invention can best be seen by reference FIGS. 1 and 2. A practice putting green platform, generally designated 21, is mounted to a base assembly, generally designated 22. As best may be seen in FIG. 2, base assembly 22 is preferably provided by two components, namely, a ring or annular member 23 and a cooperatively formed platform support structure 24. Practice putting green platform 21 includes at least one hole or cup 26 (preferably three cups 26) positioned proximate one side of the platform. In the preferred embodiment, platform 21 is an elongated platform (for example, 6–10 feet long and 3–5 feet wide), and holes or cups 26 are positioned at or proximate end 27 of the platform. Platform 21 also includes a player support area, generally designated 28 and a putting or putting green-simulating surface 29 extending between the player support area and the cups or holes 26. Putting green-simulating surface 29 can take various forms, and such surfaces are available from a plurality of possible manufacturers. Generally such surfaces are rug-like and are flexible. Suitable putting green-simulating surfaces are commercially marketed under the trademarks PROGREEN, SPORTEXE, NOVAGRAS and KOLON.

As will be seen from FIG. 1 and FIGS. 4A–4C, platform 21 is cantilevered from base assembly 22 outwardly of one side of the base. A player practicing putting stands on player support area 28 in a superimposed relation over base assembly 22, as will be explained in more detail hereinafter. Platform 21 is movably mounted to base 22 for upward and downward tilting, as well as side-to-side tilting. When platform 21 is unweighted, that is, when the player is not standing on player support area 28, the platform can be readily tilted relative to base 22. However, when the weight of a player standing on player support area 28 is superimposed over base 22, platform 21 is frictionally held in the desired adjusted angular tilt relative to base 22. In the most preferred form of the present invention, a counterbalancing weight 31 also is provided on platform support structure 24 to at least partially counterbalance the platform weight as it is cantilevered from the base. This facilitates tilting of the platform and holding of its tilt in the unweighted condition.

It is known to provide an arcuate support surface for a golf practice device platform. A cylindrical surface, for example, is employed in U.S. Pat. No. 5,046,741 to support a platform for side-to-side tilting. The cylindrical surface can also be pivoted about a vertical axis to orient the side-to-side tilt at any angle about the axis, which allows compound angular displacement. The surface or platform, however, does not support the golfer, does not employ a spherical support base and the platform is balanced over the base, rather than cantilevered from only one side thereof.

Figure 3A:
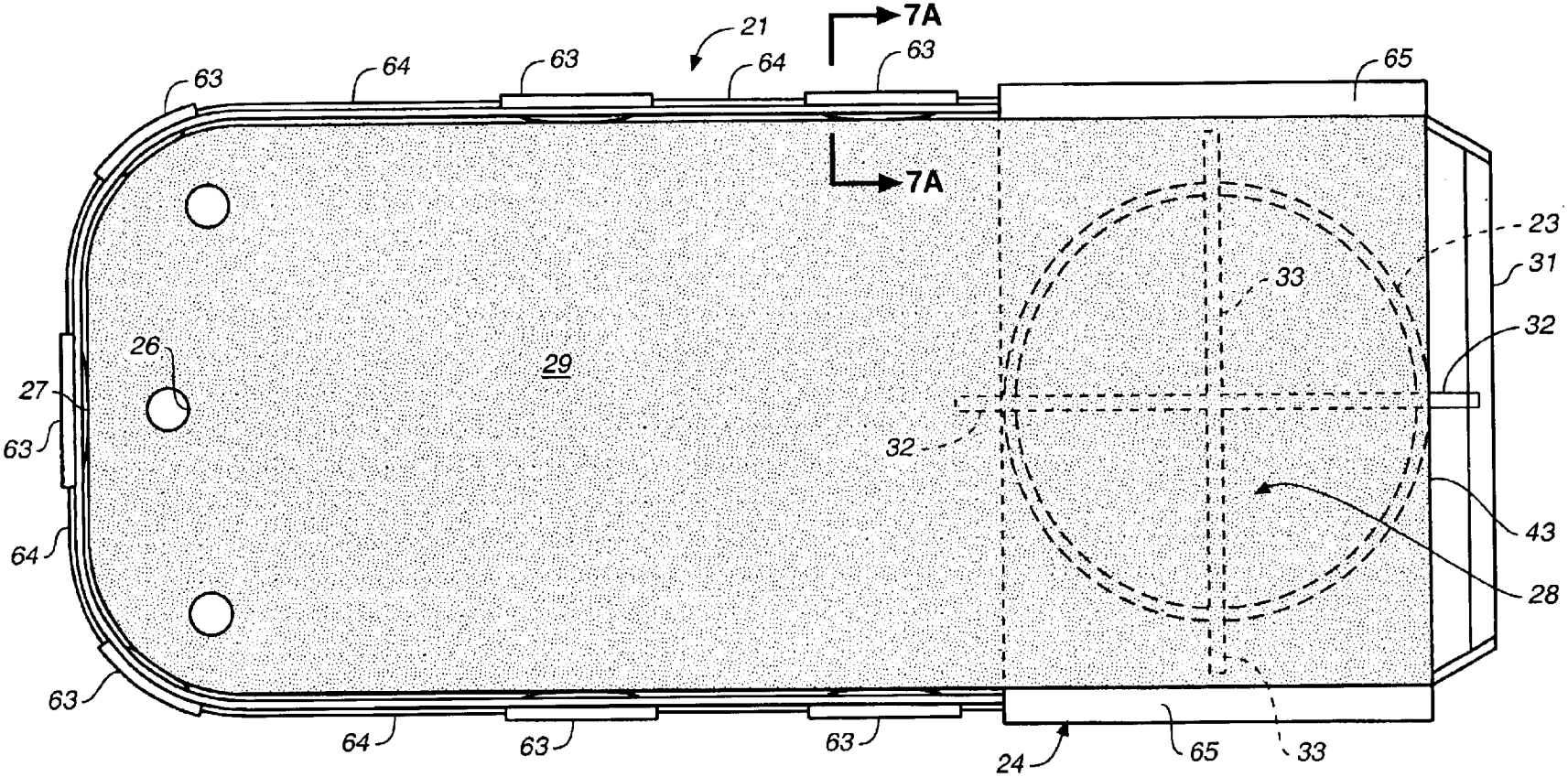
FIG. 3A is a top plan view of the assembly of FIG. 1.
Figure 3B:
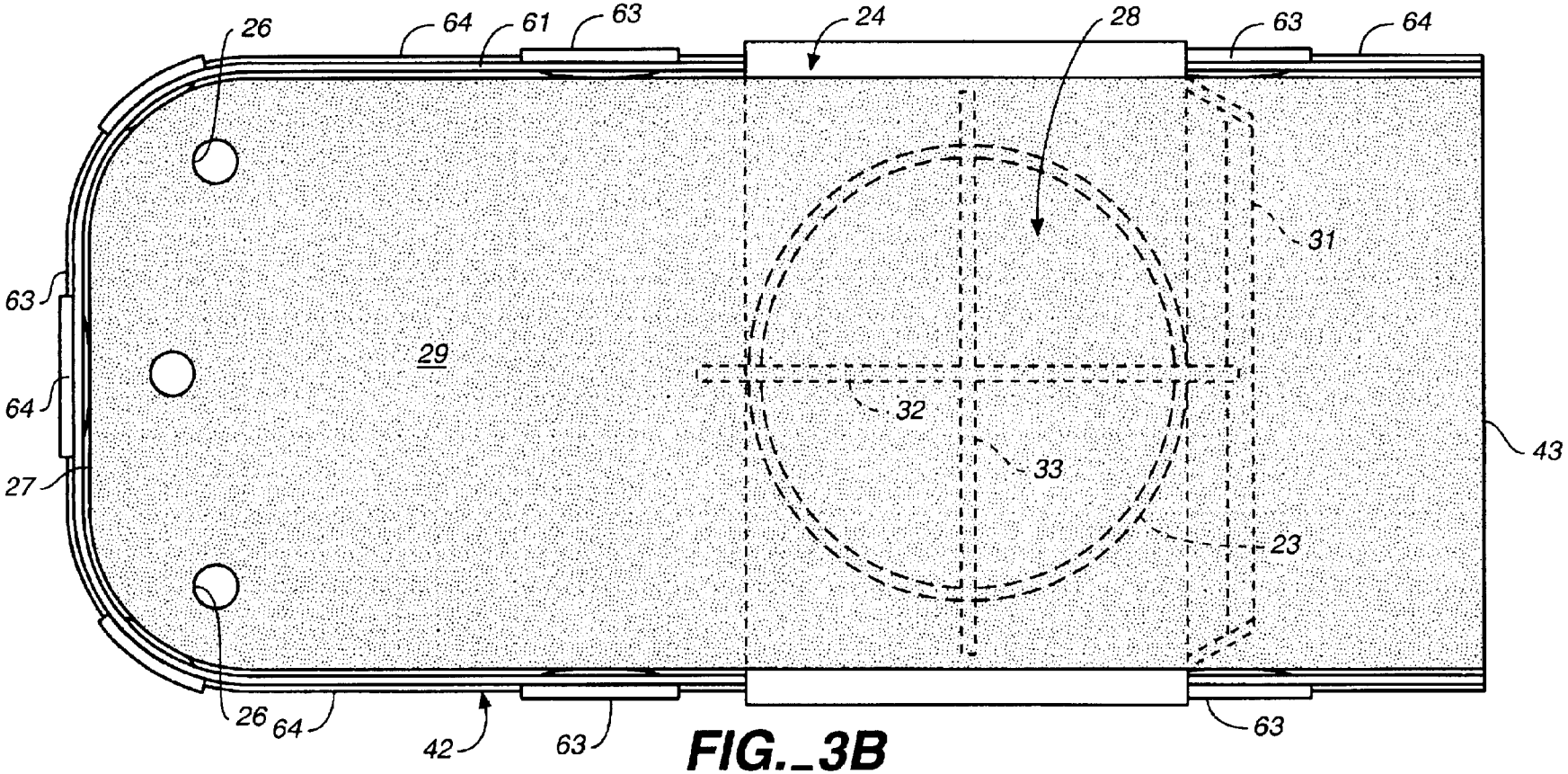
FIG. 3B is a top plan view corresponding to FIG. 3A in a moved position.
Figure 4A:
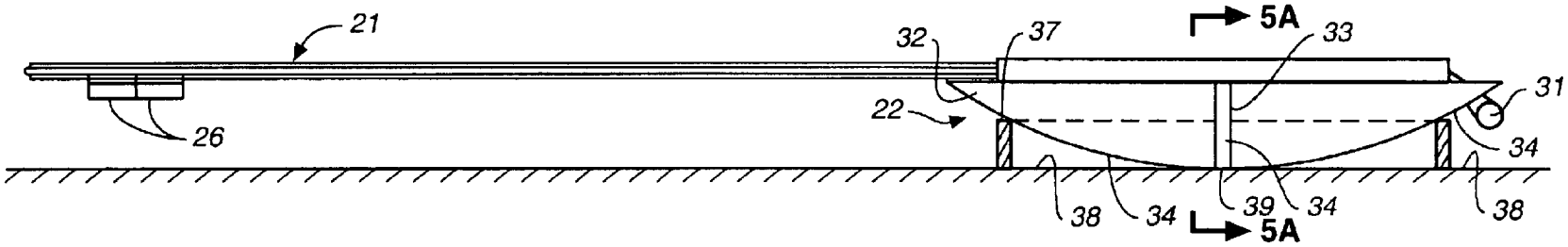
FIG. 4A is a side elevation view of the assembly of FIG. 1 in a horizontal orientation.
Figure 4B:
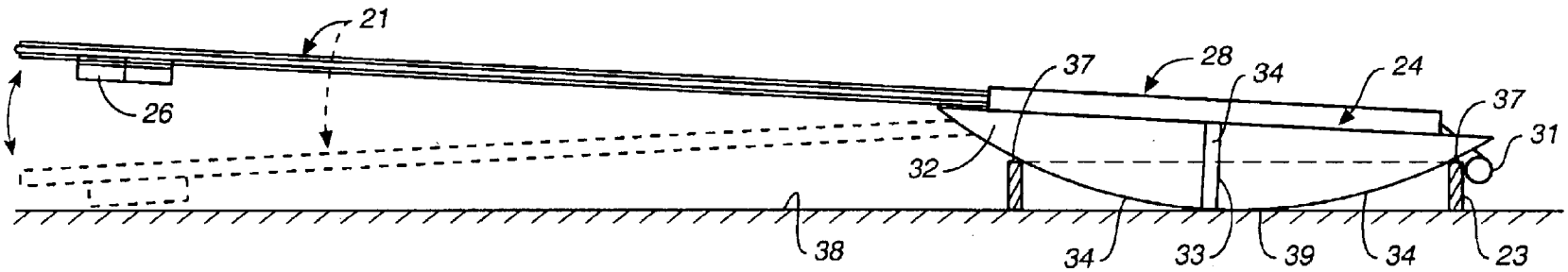
FIG. 4B is a side elevation view corresponding to FIG. 4A of the assembly showing an upwardly tilted position in solid lines and a downwardly tilted position in broke lines.
Figure 4C:
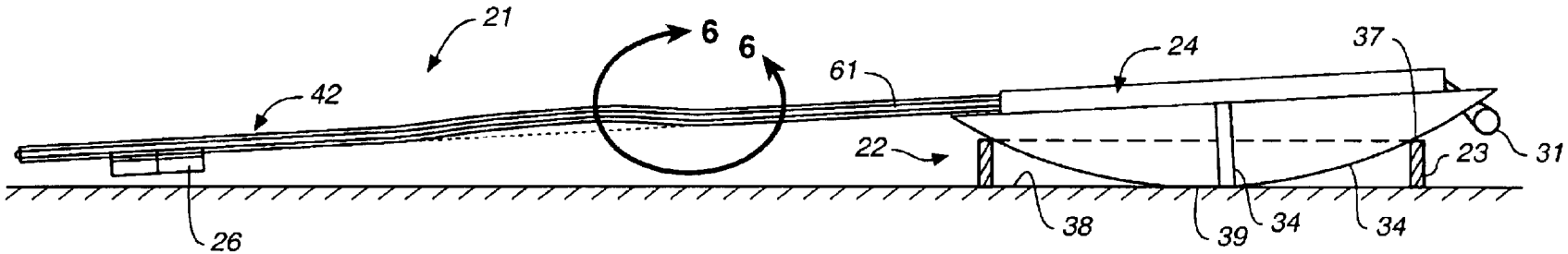
FIG. 4C is a side elevation view of the assembly of FIG. 3A showing the assembly in a downwardly tilted position with a contour formed in the putting surface.

In the preferred embodiment of the practice putting green assembly of the present invention, however, universal tilting of platform 21 is provided by forming base 22 with a spherical support structure. Such a structure may be provided by a continuous spherical surface, FIGS. 5A and 5B, or, as shown in FIGS. 2–4C, by a cruciform structure having spherical downwardly facing surface profiles or edges. The cruciform structure may be formed as a single molded piece or formed by two intersecting members 32 and 33 with arcuate downwardly facing edges or surfaces 34. The arcuate, and preferably spherical, surfaces 34 cooperate with an annular member or ring 23. Thus, spherical surfaces 34 engage and are supported on a top edge 37 of ring 23. As best seen in FIGS. 4A–4C, the height of ring 23 is selected so that surface 34 will engage the ground, floor or other support surface 38 at point 39 proximate the center of ring 23. Such engagement helps support the weight of the golfer standing on player support area 28.

Cruciform assembly 32,33 is secured to a transversely extending member 68 of player support assembly 24. Assembly 24 includes a pair of side channels 65 which are secured opposite side edges of member 68. Channels 65 slidably mount over side frame assembly 42 and include a leg 67 which extends inwardly over member 68 and is secured thereto by fasteners 69. The cruciform assembly 32,33 is mounted to the bottom of member 68, by brackets, fasteners or the like (not shown). Thus, when the player is not standing on player support area 28, it is a simple matter to tilt platform 21 about the center of curvature of spherical surfaces 34. Such tilting only requires that the friction between surface 34 and edge 37 of ring 23 be overcome.

Figure 5A:
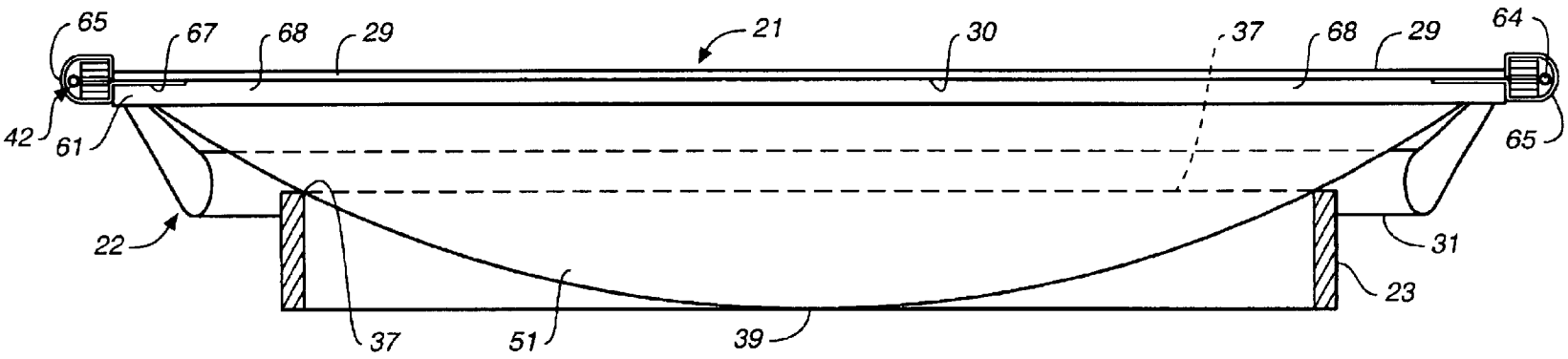
FIG. 5A is an end elevation view, in cross section, taken substantially the plane of line 5A—5A in FIG. 4A, showing an alternative embodiment of the adjustable practice putting green assembly having a continuous, spherical, platform support surface.
Figure 5B:
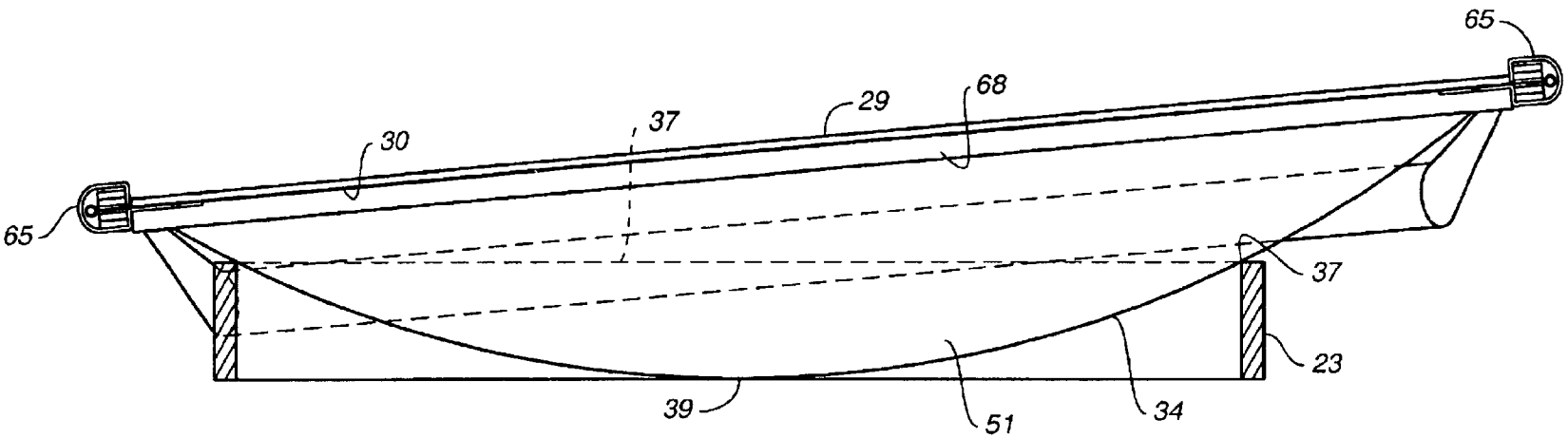
FIG. 5B is an end elevation view, in cross section, corresponding to FIG. 5A with the platform in a sidewise tilted condition.

In the embodiment shown in FIGS. 5A and 5B, base support structure 24 includes a spherical surface 51 instead of a cruciform members 32,33 (or a monolithic cruciform). Ring 23 again preferably has a height in which the spherical surface 51 will contact the support surface for the assembly a point 39 at the center of the ring so as to aid in supporting the weight of the assembly.

In both embodiments of the spherical platform support structures it is preferable that upper edge 37 of ring 23 be a soft surface which will frictionally secure the downwardly facing spherical surface 51 or cruciform edges 34. It is also possible and preferable or with surface 51. It is also possible and preferable that at least one of the downwardly or upwardly facing spherical surfaces be textured so as to provide a higher coefficient of friction for the contact between interengaged surfaces 34, 51 and edge 37. Thus, the combination of frictional engagement of surfaces 34,51 with ring edge 37, as well as counterweight 31 will cause cantilevered platform 21 to maintain a stable tilted position after adjustment by the player before the player stands on the player support area 28. High friction surfaces, however, will not prevent the player from easily adjusting the tilt of platform 21 when the player is not standing on player support area 28.

Channels 65 on base support member 24 are dimensioned to slidably receive platform frame 42, which enables platform 21 to be axially adjusted relative to channels 65 and base assembly 22, as indicated by arrows 70 in FIG. 1. This adjustment also can be seen by comparison of FIGS. 3A and 3B. In FIG. 3A, the player support area 28 is proximate the far right end 43 of platform 21, while in FIG. 3B a platform has been moved to the right relative to base assembly 22 so that the player support area 28 is now inwardly of end 43. This adjustment allows the length of the platform between player support area 28 and cups 26 to be adjusted so that putts of varying length can be practiced as well as putts of various slopes and contours.

In the broadest aspect of the present invention, the golf practice putting green assembly of the present invention can be formed for adjustment of only the slope of the putting green. Thus, green sheet 29 can be relatively rigid or flexible and no green contour adjustment can be provided. In a second aspect of the present invention, however, it is preferable that practice putting green platform 21 be provided as a flexible putting surface 29 and that platform 21 be deformable. The use of a flexible putting surface 29 on a deformable platform 21 allows not only the slope of the practice putting green to be changed, but also the contour.

Platform 21 could be constructed of a self-supporting, deformable sheet of material 30 (FIG. 1A) over which a flexible green-simulating sheet 29 is supported. For example, member 30 could be comprised of a plurality of thin aluminum sheets that are laminated or glued together to form an assembly of sheets 30 that are self-supporting and will support green sheet 29 and yet can be deformed by the user, either manually or with a tool. Such a platform 21 would not require a peripheral frame 42 for strength, but one could be provided to limit golf ball travel.

Both the angular tilting of platform 21 and its fore-and-aft movement relative to base 22 are shown as designed for manual adjustment. As will be understood, however, both movements can be powered, for example, by an electric motor and a gear assembly or frictional drive wheels. Powered adjustment also would occur when the user is not standing on player support area 28.

Figure 1A:
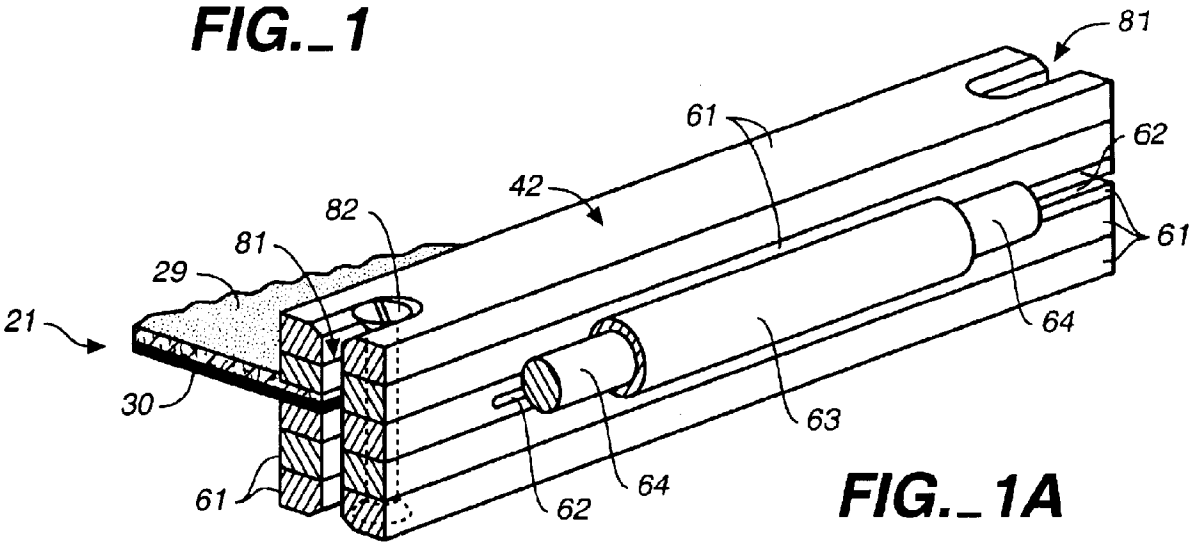
FIG. 1A is an enlarged, fragmentary, perspective view, in cross section taken substantially of the area bounded by arrows 1A—1A in FIG. 1.
Figure 6:
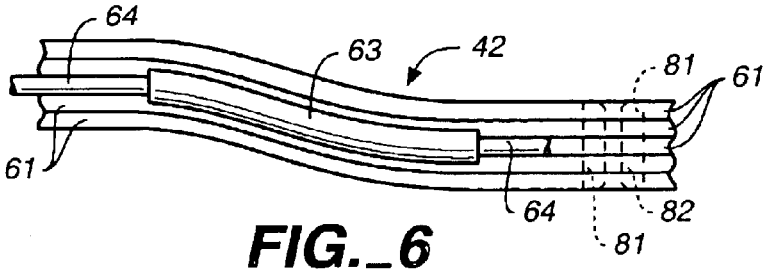
FIG. 6 is an enlarged, fragmentary, side elevation view, taken substantially of the area bounded by arrows 6—6 in FIG. 4C.
Figure 7A:
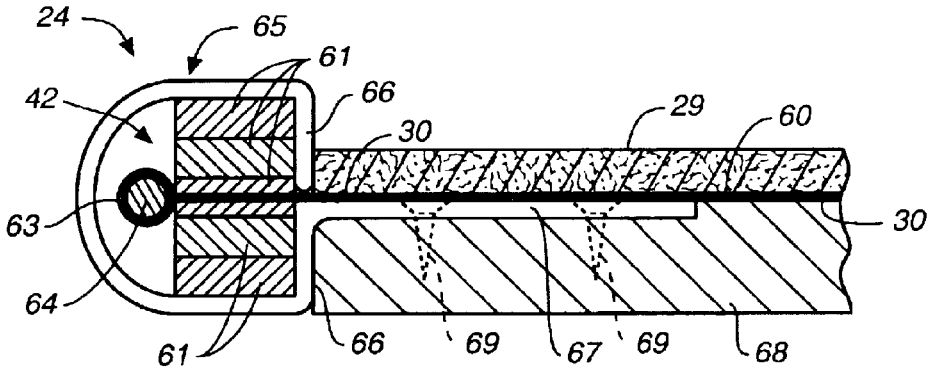
FIG. 7A is an enlarged, fragmentary, end elevation view, in cross section, taken substantially along the plane of line 7A—7A in FIG. 3A.

In the embodiment of the present invention featured in FIGS. 1–7A of the drawing a deformable peripheral frame 42 is employed in which there is a stack of frame members 61, best seen in FIGS. 1A, 6 and 7A. Frame members 61 extend around the periphery of a flexible putting surface 29. Flexible putting surface 29 can be coupled to peripheral frame assembly 42 in a number of different manners. As shown, putting surface 29 has a backing sheet 30 which extends laterally through a slit 62 one of stacked frame members 61. Periodically along the edge of the backing 30 are enlarged loops 63. A flexible rod 64 can be inserted through loops 63 to prevent withdrawal of the backing from slit 62 in the frame member.

Channel member 65 has vertical inwardly facing portions 66 which, with transverse member 68, restrain the stack of frame members 61 from moving inwardly so that flexible putting surface 29 can be distended in a tensioned condition between opposite sides of frame 42. Putting surface 29 may be adhesively secured to backing 30. Member 68 extends across the peripheral frame to resist the tension force maintained in backing 30 of flexible putting surface 29. Backing 30, however, is slidably supported on the top surface 60 of member 68 and the top surface of leg 67 of channel 65.

In order to allow deformation of the stacked frame members 61, frame members 61 are free to shift relative to each other in a longitudinal direction. This will allow the assembly of frame members 61 to be deformed, for example, to a position shown in FIG. 6 and FIG. 4C. Such longitudinal shifting can be accommodated by periodically providing longitudinal extending slots 81 through the fasteners 82 extend (FIG. 1A) to hold the assembly 42 of frame members 61 together as a unit. The friction between stacked members 61, as controlled by tightening fasteners 82, will be sufficient so that, when the peripheral frame is deformed, it will remain in substantially the same deformed condition by reason of the frictional forces between each of the slidably mounted peripheral frame members 61 and members 61.

Figure 7B:
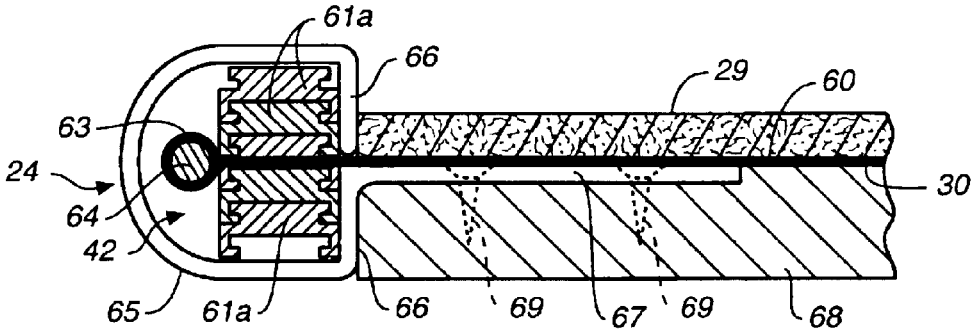
FIG. 7B is an enlarged, fragmentary, side elevation view, in cross section, corresponding to FIG. 7A and illustrating an alternative embodiment of a deformable peripheral frame for the putting green support assembly of the present invention.
Figure 7C:
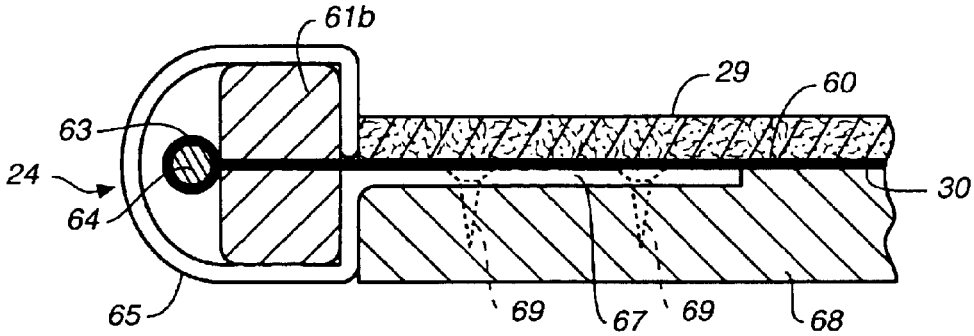
FIG. 7C is an enlarged, fragmentary, side elevation view, in cross section, corresponding to FIG. 7A of a further alternative embodiment of a deformable peripheral frame for the putting green support assembly of the present invention.

FIGS. 7B and 7C illustrate alternative embodiments of deformable peripheral frame 42. In the embodiment of FIG. 7B, a plurality of stacked frame members 61*a* are provided which have mating and interlocked cross sections. The stacked members 61*a* again are relatively displaceable in the longitudinal direction with the interlocking structures maintaining the stack. The channel portions 66 maintain the tension of backing sheet 30 of flexible putting surface 29. Inwardly extending leg 67 is again secured to transverse structural member 68 by fasteners 69.

In the embodiment of FIG. 7C, a single plastically deformable member 61*b* is provided. Such a member would have to be deformable, without memory, and could be contained within coupling channels 65, as above described. Still other possibilities exist other than the described and shown examples.

In use, the golf practice putting green assembly of the present invention can be easily assembled by sliding platform 21 into platform support structure 24 and placing the assembly on base ring 23. The golfer can then adjust the angle or slope of the green by rotating the spherical surfaces 34 on ring 23 to produce an upward, downward and/or sideward slope of putting surface 29. Additionally, the user can then deform deformable platform 21 or peripheral frame 42 to produce the desired contours in putting surface 29. As will be understood, the present golf practice putting green can be used, as shown in FIG. 4A, in a horizontal orientation or "slope." Additionally, surface 29 need not have a contour.

Once the desired orientation and contouring of putting surface 29 has been achieved, the golfer will then stand on player support area 28 which fixes or more positively holds the platform in the adjusted condition. The golfer can then putt one or more golf balls 25 toward a desired one of cups 26.

The method of the present invention, therefore, is comprised of the steps of providing or selecting a practice putting green platform which is movably mounted on a base assembly; adjusting at least one of the slope and/or contour and/or distance to the cup of the putting surface while the platform is unweighted on the base assembly; standing on the player supporting area of the platform over the base assembly to fix or hold the putting surface in the desired adjusted position; and practicing putting.

The adjustable contour and slope practice putting green assembly of the present invention, therefore, is easily assembled and disassembled for transport, can be easily and rapidly adjusted between a wide variety of slopes and contour combinations, and is very stable once adjusted by reason of the use of the player's weight to frictionally hold the cantilevered platform in the desired adjusted orientation.

What is claimed is:

1. An adjustable practice putting green assembly comprising:

a base assembly; and a practice putting green platform having a hole proximate one side thereof, a player support area spaced from the hole, and a putting surface extending therebetween;

the putting green platform being removably mounted to the base assembly for support of the putting green platform and a player standing on the player support area, on the base assembly and secured to the base assembly only by gravity, and the putting green platform extending laterally of the base assembly to position the hole at a laterally spaced distance from the base assembly; and the base assembly being formed for selective manual adjustment of the orientation of the putting green platform relative to a horizontal plane when the player is not on the platform and being formed for holding of the putting green platform in a desired adjusted orientation on the base assembly when a player stands on the player support area of the platform.

2. The practice putting green assembly as defined in claim 1 wherein, the base assembly and putting green platform are formed for cantilevered support of the putting green platform from a side of the base assembly.

3. The practice putting green assembly as defined in claim 1 wherein, the putting green platform is movably mounted to the base assembly for selective extension and retraction of the platform relative to the base assembly for adjustment of the distance between the hole and the base assembly.

4. The practice putting green assembly as defined in claim 1 wherein, the putting green platform is provided by a flexible putting green surface and a deformable peripheral frame, the flexible putting green surface being mounted to the peripheral frame, and the peripheral frame being further formed for selective deformation to produce contour changes in the flexible putting green surface and formed to contain a golf ball on the putting green surface.

5. The practice putting green assembly as defined in claim 1 wherein, the base assembly is formed with a high friction surface to hold the putting green platform in selected tilted orientations when the player stands on the player support area.

6. The practice putting green assembly as defined in claim 1 wherein, the base assembly includes an upwardly open ring member, and a mating downwardly facing platform mounting structure having a surface which falls on a sphere and is engaged and supported on the ring member.

7. The practice putting green assembly as defined in claim 6 wherein, the platform support structure includes a continuous spherical surface gravity biased into engagement with the ring member.

8. An adjustable practice putting green assembly comprising:

an annular base member having an open top; and an elongated practice putting green having a hole proximate one end thereof and a mounting structure proximate another end thereof, the mounting structure being removably mounted on top of the annular base and secured thereto only by gravity, and the mounting structure cantilevering the putting green and hole laterally of the annular base, the mounting structure having a spherical/base-engaging surface matingly and slidably mounted on the annular base member to enable selected tilting of the practice putting green about a center of the sphere.

9. The adjustable practice putting green assembly of claim 8 wherein, the practice putting green is provided by a platform mounted to a platform mounting structure carrying the spherical base-engaging surface and having a channel enabling adjustment of the distance at which the hole is laterally cantilevered from the annular base member.

10. The adjustable practice putting green assembly of 8 wherein, the spherical base-engaging surface is provided by at least two circular portions joined together at a midpoint to form a cruciform structure extending across the annular base member and having a common radius of curvature positioning the circumferences of the circular portions for engagement with a support surface on which the annular base member is positioned.

11. The adjuitable practice putting green assembly an defined in claim 8 wherein, the spherical base-engaging surface is provided by a spherical surface, and the annular base member has a height supporting the spherical surface for contact with a support surface at the center of the annular base member.

12. The adjustable practice putting green assembly as defined in claim 8 wherein, the practice putting green is provided by a peripheral frame formed to contain a golf ball on the practice putting green and a flexible putting green simulating surface distended between the frame.

13. The adjustable practice putting green assembly as defined in claim 12 wherein, the peripheral frame is selectively deformable to produce contours in the putting green simulating surface independent of tilting of the practice putting green.

14. The adjustable practice putting green assembly as defined in claim 13 wherein, the frame is formed from a selectively deformable thermoplastic material.

15. The adjustable practice putting green assembly as defined in claim 13 wherein, the frame is formed from a plurality of frame members slidably mounted together in a stacked array, and at least one member securing the frame members in the stacked arrays.

16. The adjustable practice putting green assembly as defined in claim 15 wherein, the frame members are cooperatively interlocked and mounted in nested relation for relative sliding motion.

17. The adjustable practice putting green assembly as defined in claim 8, and a counterweight secured to the practice putting green on a side thereof opposite to the side on which the hole is cantilevered laterally from the annular base member.

18. The adjustable practice putting green assembly as defined in claim 8 wherein, at least one of the mounting structure and the annular base member are formed with high friction surfaces producing securement of the prartice putting green against motion relative to the annular base member in a selected tilted orientation when a player stands on the practice putting green.

19. An adjustable practice putting green assembly comprising:

a base assembly invluding an upwardly open ring member and a mating downwardly facing platform mounting structure having a surfuco which falls on a sphere and is engaged and supported on the ring member; and a practice putting green platform having a hole proximate one side thereof, a player support area spaced from the hole, and a putting surface extending therebetween;

the putting green platform being mounted to the base assembly for support of the putting green platform and a player standing on the player support area, on the base assembly, and the putting green platform extending laterally of the base assembly to position the hole at a laterally spaced distance from the base assembly and being alidably mounted to the platform mounting structure of the base assembly to vary the distance that the hole extends laterally of the base assembly, and the base assembly being formed for selective manual adjustment of the orientation of the putting green platform relative to a horizontal plane when the player is not on the platform and being formed for holding of the putting green platform in a desired adjusted orientation on the base assembly when a player stands on the player support area of the platform.

20. The practice putting green assembly as defined in claim 19 wherein, the player support area is an area on the putting green platform positioned over the base assembly for any lateral position of the hole.

21. The practice putting green assembly as defined in claim 19 wherein, the putting green platform is slidably mounted to the base assembly by a channel on the platform mounting structure.

* * * * *